US011835273B2

(12) United States Patent
Yamada et al.

(10) Patent No.: US 11,835,273 B2
(45) Date of Patent: Dec. 5, 2023

(54) REFRIGERANT CYCLE APPARATUS

(71) Applicant: DAIKIN INDUSTRIES, LTD., Osaka (JP)

(72) Inventors: Yuji Yamada, Osaka (JP); Shinichi Takahashi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/681,140

(22) Filed: Feb. 25, 2022

(65) Prior Publication Data

US 2022/0275984 A1 Sep. 1, 2022

(30) Foreign Application Priority Data

Feb. 26, 2021 (JP) ..... 2021-030004

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01); *F25B 2313/02741* (2013.01); *F25B 2400/13* (2013.01); *F25B 2600/2501* (2013.01)

(58) Field of Classification Search
CPC ..... F25B 41/20; F25B 13/00; F25B 2313/02741; F25B 2400/13;
(Continued)

(56) References Cited

U.S. PATENT DOCUMENTS 8,538,585 B2 * 9/2013 Thogersen ..... F25D 29/003 700/275
2014/0331702 A1 * 11/2014 Tanaka ..... F25B 49/02 62/159

FOREIGN PATENT DOCUMENTS

CN 109356854 A * 2/2019 ..... F04B 41/00
CN 109356854 A * 2/2019 ..... F04B 41/00
(Continued)

OTHER PUBLICATIONS

Pdf is translation of foreign reference CN-111201411-A (Year: 2020).*

(Continued)

*Primary Examiner* — Len Tran
*Assistant Examiner* — Kamran Tavakoldavani
(74) *Attorney, Agent, or Firm* — Birch, Stewart, Kolasch & Birch, LLP

(57) ABSTRACT

A refrigerant cycle apparatus includes a main refrigerant circuit, a bypass circuit, and a controller. The main refrigerant circuit includes a compressor, a heat source-side heat exchanger, a heat source-side expansion valve, and a utilization-side heat exchanger. The controller performs a second operation of opening a hot gas bypass valve in a state in which the compressor is driven before performing a first operation in which the heat source-side heat exchanger serves as a heat absorber for the refrigerant and the utilization-side heat exchanger serves as a radiator for the refrigerant. In the first operation or the second operation, when a difference between a pressure of the refrigerant on the discharge side of the compressor and a pressure of the refrigerant on the suction side of the compressor becomes larger than a first predetermined value, the controller decreases the number of revolutions of the compressor.

10 Claims, 7 Drawing Sheets

(58) Field of Classification Search
CPC ..... F25B 2400/0401; F25B 2600/2501; F25B 2500/26; F25B 2600/027; F25B 2600/0272; F25B 2700/193; F25B 2700/1931; F25B 2700/1933
See application file for complete search history.

(56) References Cited

FOREIGN PATENT DOCUMENTS

| | | | | | |
|---|---|---|---|---|---|
| CN | 111201411 | A | * | 5/2020 | ..... F24F 11/36 |
| CN | 111201411 | A | * | 5/2020 | ..... F24F 11/36 |
| JP | 2000016073 | A | * | 1/2000 | |
| JP | 2010-249464 | A | | 11/2010 | |

OTHER PUBLICATIONS

Pdf is translation of foreign reference CN-109356854-A (Year: 2019).*
Pdf is translation of foreign reference JP-2000016073-A (Year: 2000).*
Pdf file is translation of foreign reference CN-111201411-A (Year: 2020).*
Pdf file is translation of foreign reference CN-109356854-A (Year: 2019).*

* cited by examiner

REFRIGERANT CYCLE APPARATUS

FIELD OF THE INVENTION

The present disclosure relates to a refrigerant cycle apparatus.

DESCRIPTION OF THE RELATED ART

As described in Patent Literature 1 (JP 2010-249464 A), a refrigeration cycle apparatus including a refrigerant circuit having a hot gas bypass pipe that bypasses a high-pressure gas refrigerant discharged from a compressor from a discharge side to a suction side of the compressor is known.

SUMMARY OF THE INVENTION

Sound of a refrigerant passing through an electromagnetic valve attached to a hot gas bypass pipe may increase.

A refrigerant cycle apparatus according to a first aspect includes a main refrigerant circuit, a bypass circuit, a first sensor, a second sensor, and a control unit. The main refrigerant circuit includes a compressor, a four-way switching valve, a first heat exchanger, an expansion mechanism, and a second heat exchanger. A refrigerant circulates through the main refrigerant circuit. The bypass circuit includes a first valve that opens and closes. The bypass circuit branches off from a pipe on a discharge side of the compressor and is connected to a pipe on a suction side of the compressor. The first sensor acquires a first pressure that is a pressure of the refrigerant on the discharge side of the compressor. The second sensor acquires a second pressure that is a pressure of the refrigerant on the suction side of the compressor. The control unit performs a second operation of opening the first valve in a state in which the compressor is driven, before performing a first operation in which the first heat exchanger serves as a heat absorber of the refrigerant and the second heat exchanger serves as a radiator of the refrigerant. In the first operation or the second operation, the control unit reduces the number of revolutions of the compressor when a pressure difference, which is a difference between the first pressure and the second pressure, becomes larger than a first predetermined value.

In this refrigerant cycle apparatus, the pressure difference between the discharge side and the suction side of the compressor is suppressed, and thus, thereby suppressing the sound of the refrigerant passing through the bypass circuit during an operation.

In the refrigerant cycle apparatus according to a second aspect, in the refrigerant cycle apparatus according to the first aspect, the four-way switching valve may have a first state and a second state. The first state may be a state in which the discharge side of the compressor communicates with the second heat exchanger and the suction side of the compressor communicates with the first heat exchanger. The second state may be a state in which the discharge side of the compressor communicates with the first heat exchanger and the suction side of the compressor communicates with the second heat exchanger. When the pressure difference becomes equal to or larger than the second predetermined value in the second operation, the control unit may determine that the four-way switching valve has been switched from the second state to the first state. The control unit may open the first valve after determining that the four-way switching valve has been switched from the second state to the first state.

In this refrigerant cycle apparatus, the bypass circuit is closed until the four-way switching valve is switched at the time of startup, and thus, the pressure difference between the discharge side and the suction side of the compressor is appropriately secured.

In the refrigerant cycle apparatus according to a third aspect, in the refrigerant cycle apparatus according to the second aspect, the first predetermined value may be larger than the second predetermined value.

In this refrigerant cycle apparatus, the pressure difference between the discharge side and the suction side of the compressor is maintained within an appropriate range.

In the refrigerant cycle apparatus according to a fourth aspect, in the refrigerant cycle apparatus according to the second aspect, the control unit may reduce the number of rotations of the compressor when the pressure difference becomes larger than the first predetermined value after the first valve is opened.

In this refrigerant cycle apparatus, the pressure difference between the discharge side and the suction side of the compressor is maintained within an appropriate range.

In the refrigerant cycle apparatus according to a fifth aspect, in the refrigerant cycle apparatus according to the second aspect, the four-way switching valve may have a first state and a second state. The first state may be a state in which the discharge side of the compressor communicates with the second heat exchanger and the suction side of the compressor communicates with the first heat exchanger. The second state may be a state in which the discharge side of the compressor communicates with the first heat exchanger and the suction side of the compressor communicates with the second heat exchanger. When the four-way switching valve is in the first state at a previous stop of the compressor, the control unit may open the first valve at the same time as the startup of the compressor in the second operation.

In this refrigerant cycle apparatus, when the four-way switching valve is already switched to an appropriate state at the time of the startup, the bypass circuit is opened at the same time as the startup, and thus, a time required at the time of the startup is shortened.

In the refrigerant cycle apparatus according to a sixth aspect, in the refrigerant cycle apparatus according to the first aspect, the control unit may terminate the second operation and start the first operation when a first condition is satisfied. The first condition may include any one of the first pressure being larger than a third predetermined value, the second pressure being larger than a fourth predetermined value, the pressure difference is larger than a fifth predetermined value, and an elapsed time from the startup of the compressor being longer than a first predetermined time.

This refrigerant cycle apparatus prevents a normal operation from being stopped.

In the refrigerant cycle apparatus according to a seventh aspect, in the refrigerant cycle apparatus according to the first aspect, the control unit may close the first valve when a second condition is satisfied. The second condition may include any one of a degree of superheating of the refrigerant discharged from the compressor being larger than a sixth predetermined value, the pressure difference being larger than a seventh predetermined value, and an elapsed time from the startup of the compressor being longer than a second predetermined time.

This refrigerant cycle apparatus prevents the normal operation from being continued with the bypass circuit kept open.

In the refrigerant cycle apparatus according to an eighth aspect, in the refrigerant cycle apparatus according to the first aspect, the control unit may increase an opening degree of the expansion mechanism when the first valve is closed.

In this refrigerant cycle apparatus, after the bypass circuit is closed, the operation can be continued without temporarily decreasing the number of revolutions of the compressor.

In the refrigerant cycle apparatus according to a ninth aspect, in the refrigerant cycle apparatus according to the eighth aspect, the control unit may control the opening degree of the expansion mechanism based on the amount of the refrigerant flowing through the main refrigerant circuit, when the first valve is closed.

In this refrigerant cycle apparatus, the opening degree of the expansion mechanism is appropriately controlled during an operation.

In the refrigerant cycle apparatus according to a tenth aspect, in the refrigerant cycle apparatus according to the eighth aspect, the control unit may control the opening degree of the expansion mechanism based on a refrigerant temperature on an outlet side of the first heat exchanger, in the first operation. The control unit may increase the opening degree of the expansion mechanism when the first valve is closed, in the first operation or the second operation.

In this refrigerant cycle apparatus, even when the bypass circuit is closed during the normal operation, the opening degree of the expansion mechanism is appropriately controlled.

DETAILED DESCRIPTION OF PREFERRED EMBODIMENTS (1) Configuration of Refrigerant Cycle Apparatus 100

Description is made to a refrigerant cycle apparatus 100 according to an embodiment of the present disclosure. The refrigerant cycle apparatus 100 is an air conditioner that performs a cooling operation and a heating operation in a predetermined air conditioning target space by a vapor compression refrigerant cycle.

Figure 1:
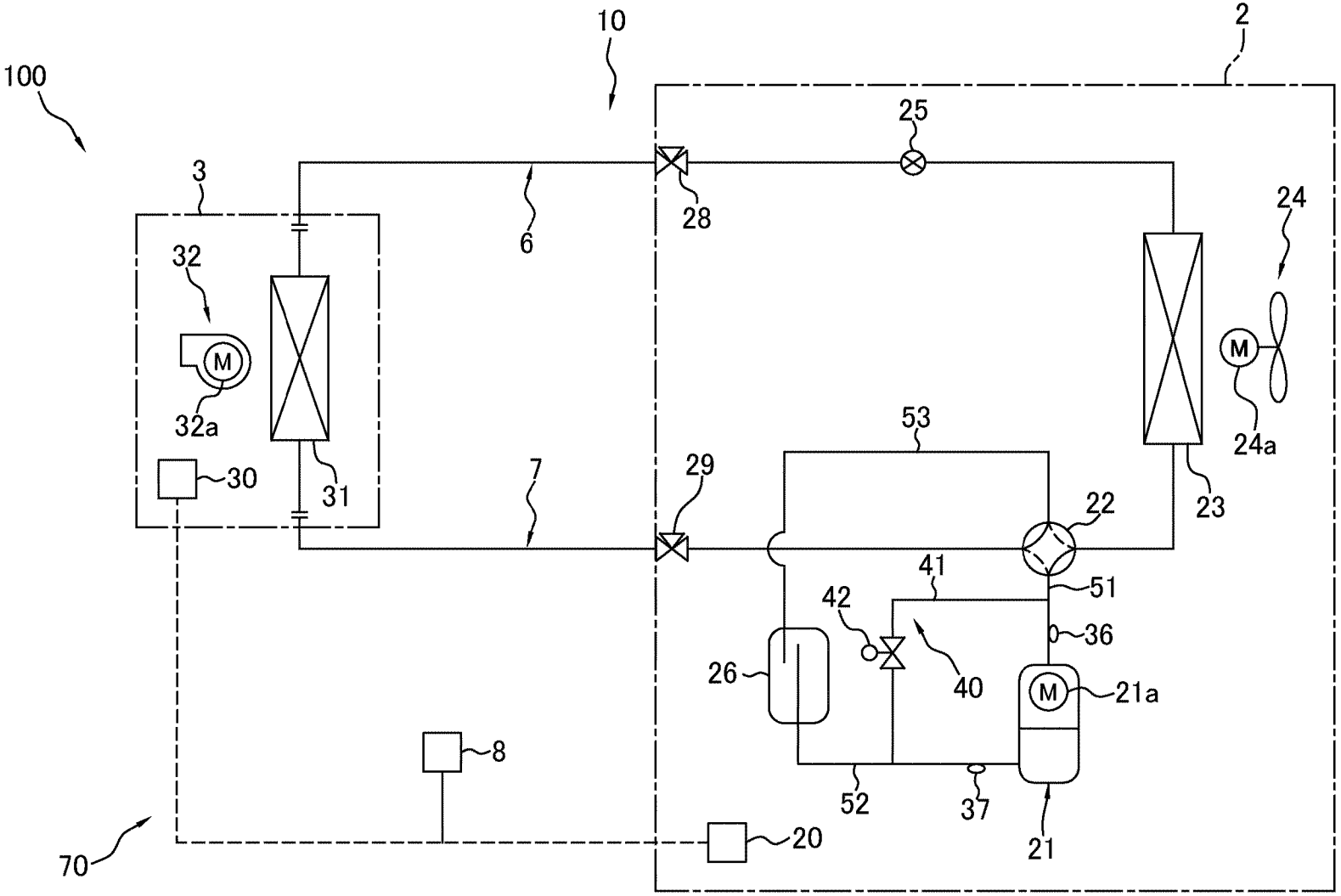
FIG. 1 is a schematic configuration diagram of a refrigerant cycle apparatus 100 according to an embodiment.

As illustrated in FIG. 1, the refrigerant cycle apparatus 100 mainly includes a heat source unit 2, a utilization unit 3, a liquid-side connection pipe 6, a gas-side connection pipe 7, a remote controller 8, and a control unit 70. In the refrigerant cycle apparatus 100, the heat source unit 2 and the utilization unit 3 are connected via the liquid-side connection pipe 6 and the gas-side connection pipe 7 to form a main refrigerant circuit 10 through which the refrigerant circulates.

The refrigerant cycle apparatus 100 performs a vapor compression refrigerant cycle in which the refrigerant sealed in the main refrigerant circuit 10 is compressed, condensed, decompressed, evaporated, and then compressed again. The refrigerant sealed in the main refrigerant circuit 10 is, for example, R32 and R410A.

The refrigerant cycle apparatus 100 may include a plurality of utilization units 3. In this case, the main refrigerant circuit 10 is configured by connecting a plurality of utilization units 3 in parallel to one heat source unit 2.

(1-1) Heat Source Unit 2

The heat source unit 2 is installed outdoors, such as outside a building having an air conditioning target space. As illustrated in FIG. 1, the heat source unit 2 mainly includes a compressor 21, a four-way switching valve 22, a heat source-side heat exchanger 23, a heat source-side fan 24, a heat source-side expansion valve 25, a low-pressure receiver 26, a liquid-side shutoff valve 28, a gas-side shutoff valve 29, a discharge-side sensor 36, a suction-side sensor 37, and a bypass circuit 40.

The compressor 21 is a device that compresses a low-pressure refrigerant to a high pressure refrigerant in a refrigerant cycle. The compressor 21 has a sealed structure in which a variable volume compression element (not illustrated) such as a rotary type compressor or a scroll type compressor is rotationally driven by compressor motor 21*a*. The compressor motor 21*a* can control an operation frequency (the number of revolutions of the compressor 21) by an inverter.

The four-way switching valve 22 switches between a cooling operation connection state (second state) and a heating operation connection state (first state) by switching the connection state of the main refrigerant circuit 10. In the cooling operation connection state (a state indicated by a solid line in FIG. 1), the discharge side of the compressor 21 and the gas side of the heat source-side heat exchanger 23 are connected to each other, and the suction side of the compressor 21 and the gas-side shutoff valve 29 are connected to each other. In the heating operation connection state (a state indicated by a dotted line in FIG. 1), the discharge side of the compressor 21 and the gas-side shutoff valve 29 are connected to each other, and the suction side of the compressor 21 and the gas side of the heat source-side heat exchanger 23 are connected to each other. One of connection ports of the four-way switching valve 22 is connected to the discharge side of the compressor 21 via the first pipe 51.

The heat source-side heat exchanger 23 functions as a radiator (condenser) of the high-pressure refrigerant in the refrigeration cycle during the cooling operation, and functions as a heat absorber (evaporator) of the low-pressure refrigerant in the refrigeration cycle during the heating operation.

The heat source-side fan 24 supplies air (outside air or the like) outside the air conditioning target space into the heat source unit 2 to the heat source-side heat exchanger 23, causes the heat source-side heat exchanger 23 to exchange heat with the refrigerant, and then generates an air flow for discharge the refrigerant to the outside of the heat source unit 2. The heat source-side fan 24 is rotationally driven by a heat source-side fan motor 24*a*.

The heal source-side expansion valve 25 is a throttling mechanism having a function of decompressing the refrigerant. The heat source-side expansion valve 25 is provided between the liquid side of the heat source-side heat exchanger 23 and the liquid-side shutoff valve 28. The heat source-side expansion valve 25 is an electric expansion valve of which an opening degree is adjustable by control of the control unit 70.

The low-pressure receiver 26 is provided between the suction side of the compressor 21 and one of the connection ports of the four-way switching valve 22. An end portion of a second pipe 52 extending from the suction side of the compressor 21 and an end portion of a third pipe 53 extending from one of the connection ports of the four-way switching valve 22 are disposed inside the low-pressure receiver 26. The second pipe 52 and the third pipe 53 are connected to each other via the low-pressure receiver 26. The low-pressure receiver 26 is a refrigerant container capable of temporarily storing a surplus refrigerant in the main refrigerant circuit 10 as a liquid refrigerant.

The liquid-side shutoff valve 28 is a manual valve disposed at a connection portion of the heat source unit 2 with the liquid-side connection pipe 6.

The gas-side shutoff valve 29 is a manual valve disposed at a connection portion of the heat source unit 2 with the gas-side connection pipe 7.

The bypass circuit 40 mainly includes a hot gas bypass pipe 41 and a hot gas bypass valve 42. The hot gas bypass pipe 41 bypasses the first pipe 51 and the second pipe 52. Specifically, the hot gas bypass pipe 41 branches off from the first pipe 51 and is connected to the second pipe 52. As a result, a part of the high-pressure refrigerant discharged from the compressor 21 and flowing through the first pipe 51 is returned to the second pipe 52 through which the low-pressure refrigerant before being sucked into the compressor 21 flows via the hot gas bypass pipe 41. The hot gas bypass valve 42 is provided in the middle of the hot gas bypass pipe 41. The hot gas bypass valve 42 is an electromagnetic valve or an electric expansion valve of which an opening degree is adjustable by control of the control unit 70. The bypass circuit 40 is provided, for example, to suppress a decrease in pressure on the suction side of the compressor 21 and to increase the temperatures of the refrigerant and the refrigerating machine oil inside the compressor 21.

The discharge-side sensor 36 is attached to the first pipe 51. The discharge-side sensor 36 is provided between the discharge side of the compressor 21 and a position where the hot gas bypass pipe 41 is connected to the first pipe 51. The discharge-side sensor 36 is a sensor that detects a discharge pressure that is a pressure of the refrigerant on the discharge side of the compressor 21. The discharge-side sensor 36 may be a sensor that detects a discharge temperature that is a temperature of the refrigerant on the discharge side of the compressor 21, in this case, the control unit 70 calculates the discharge pressure from the discharge temperature detected by the discharge-side sensor 36. The control unit 70 may calculate the discharge pressure from the condensation temperature of the refrigerant.

The suction-side sensor 37 is attached to the second pipe 52. The suction-side sensor 37 is provided between the suction side of the compressor 21 and a position where the hot gas bypass pipe 41 is connected to the second pipe 52. The suction-side sensor 37 is a sensor that detects a suction pressure that is a pressure of the refrigerant on the suction side of the compressor 21. The suction-side sensor 37 may be a sensor that detects a suction temperature that is a temperature of the refrigerant on the suction side of the compressor 21. In this case, the control unit 70 calculates the suction pressure from the suction temperature detected by the suction-side sensor 37. The control unit 70 may calculate the suction pressure from the evaporation temperature of the refrigerant.

The heat source unit 2 also includes a heat source unit control unit configured to control operations of the respective components constituting the heat source unit 2. The heat source unit control unit 20 constitutes the control unit 70. The heat source unit control unit 20 includes a microcomputer including, for example, a central processing unit (CPU) and a memory. The heat source unit control unit 20 is connected to the utilization unit control unit 30 of the utilization unit 3 via a communication line, and transmits and receives a control signal and the like.

(1-2) Utilization Unit 3

The utilization unit 3 is installed on a wall, a ceiling, or the like of a room or the like that is the air conditioning target space. As illustrated in FIG. 1, the utilization unit 3 mainly includes a utilization-side heat exchanger 31 and a utilization-side fan 32.

The utilization-side heat exchanger 31 functions as a heat absorber (evaporator) of the low-pressure refrigerant in the refrigeration cycle during the cooling operation, and functions as a radiator (condenser) of the high-pressure refrigerant in the refrigeration cycle during the heating operation. A pipe extending from the liquid side of the utilization-side heat exchanger 31 is connected to the liquid-side connection pipe 6. A pipe extending from the gas side of the utilization-side heat exchanger 31 is connected to the gas-side connection pipe 7.

The utilization-side fan 32 supplies the air in the air conditioning target space into the utilization unit 3 to the utilization-side heat exchanger 31, causes the utilization-side heat exchanger 31 to exchange heat with the refrigerant, and then generates an air flow to be discharged into the air conditioning target space. The utilization-side fan 32 is rotationally driven by a utilization-side fan motor 32*a*.

The utilization unit 3 includes the utilization unit control unit 30 that controls operation of each component constituting the utilization unit 3. The utilization unit control unit 30 constitutes the control unit 70. The utilization unit control unit 30 is, for example, a microcomputer including a CPU, a memory, and the like. The utilization unit control unit 30 is connected to the heat source unit control unit 20 of the heat source unit 2 via a communication line, and transmits and receives a control signal and the like.

(1-3) Remote Controller 8

The remote controller 8 is disposed in the air conditioning target space or a specific space in a building having the air conditioning target space. The remote controller 8 functions as an input device for a user of the refrigerant cycle apparatus 100 to input various instructions to the refrigerant cycle apparatus 100. For example, a user operates the remote controller 8 to switch the operation state (healing operation or cooling operation) of the refrigerant cycle apparatus 100 or adjust a set temperature of the air conditioning target space. The remote controller 8 also functions as a display device for displaying the operation state of the refrigerant cycle apparatus 100 and predetermined notification information. The remote controller 8 is connected to the heat source unit control unit 20 and the utilization unit control unit 30 via communication lines, and transmits and receives signals to and from each other.

(1-4) Control Unit 70

In the refrigerant cycle apparatus 100, the heat source unit control unit 20 and the utilization unit control unit 30 are connected to each other via a communication line to constitute the control unit 70 that is hardware fir controlling the operation of the refrigerant cycle apparatus 100. The control by the control unit 70 is achieved by the heat source unit control unit 20 and the utilization unit control unit 30 operating integrally. Details of the control by the control unit 70 will be described later.

(2) Operating Mode of Refrigerant Cycle Apparatus 100

The refrigerant cycle apparatus 100, which is an air conditioner, operates in a cooling operation mode or a heating operation mode to adjust the temperature and humidity of the air in the air conditioning target space. The control unit 70 determines which of the cooling operation mode and the heating operation mode the vehicle is to be operated in based on the instruction input to the remote controller 8 by the user.

(2-1) Cooling Operation Mode

In the cooling operation mode, the control unit 70 brings the four-way switching valve 22 into the cooling operation connection state and executes the cooling operation in the air conditioning target space. In the cooling operation mode, for example, the control unit 70 controls the number of revolutions of the compressor 21 so that an evaporation temperature of the refrigerant in the main refrigerant circuit 10 becomes the target evaporation temperature. In the cooling operation mode, the hot gas bypass valve 42 is closed.

In the cooling operation mode, the gas refrigerant discharged from the compressor 21 of the heat source unit 2 passes through the first pipe 51 and the four-way switching valve 22, and flows through the heat source-side heat exchanger 23. The refrigerant flowing through the heat source-side heat exchanger 23 radiates heat or is condensed by heat exchange with outdoor air, and then flows toward the heat source-side expansion valve 25. The control unit 70 controls the opening degree of the heat source-side expansion valve 25 located between the heat source-side heat exchanger 23 and the utilization-side heat exchanger 31 so as to satisfy conditions such as a degree of subcooling of the heat source-side heat exchanger 23 and a degree of superheating of the utilization-side heat exchanger 31 becoming predetermined target values.

The refrigerant decompressed by the heat source-side expansion valve 25 passes through the liquid-side shutoff valve 28 and the liquid-side connection pipe 6, flows into the utilization unit 3, and flows through the utilization-side heat exchanger 31. The refrigerant flowing through the utilization-side heat exchanger 31 absorbs heat or evaporates by heat exchange with air in the air conditioning target space, then flows through the gas-side connection pipe 7, and flows from the gas-side shutoff valve 29 into the heat source unit 2. The refrigerant that has flowed into the heat source unit 2 is again sucked into the compressor 21 via the four-way switching valve 22, the third pipe 53, the low-pressure receiver 26, and the second pipe 52. In the low-pressure receiver 26, the liquid refrigerant that has not evaporated in the utilization-side heat exchanger 31 is stored as the surplus refrigerant.

(2-2) Heating Operation Mode

In the heating operation mode, the control unit 70 brings the four-way switching valve 22 into the heating operation connection state to execute the heating operation in the air conditioning target space. In the heating operation mode, for example, the control unit 70 controls the number of revolutions of the compressor 21 so that the condensation temperature of the refrigerant in the main refrigerant circuit 10 becomes a target condensation temperature. In the heating operation mode, the hot gas bypass valve 42 is closed or opened depending on the situation.

In the heating operation mode, the gas refrigerant discharged from the compressor 21 of the heat source unit 2 passes through the first pipe 51, the four-way switching valve 22, the gas-side shutoff valve 29, and the gas-side connection pipe 7, flows into the utilization unit 3, and flows through the utilization-side heat exchanger 31. The refrigerant flowing through the utilization-side heat exchanger 31 radiates heat or is condensed by heat exchange with air in the air conditioning target space, then flows through the liquid-side connection pipe 6, and flows from the liquid-side shutoff valve 28 into the heat source unit 2. The refrigerant that has flowed into the heat source unit 2 is decompressed by the heat source-side expansion valve 25. The control unit 70 controls the opening degree of the heat source-side expansion valve 25 located between the utilization-side heat exchanger 31 and the heat source-side heat exchanger 23 so as to satisfy conditions such as the degree of subcooling of the utilization-side heat exchanger 31 and the degree of superheating of the heat source-side heat exchanger 23 becoming predetermined target values.

The refrigerant decompressed by the heat source-side expansion valve 25 flows through the heat source-side heat exchanger 23. The refrigerant flowing through the heat source-side heat exchanger 23 absorbs heat or evaporates by heat exchange with outdoor air, and then is sucked into the compressor 21 again via the four-way switching valve 22, the third pipe 53, the low-pressure receiver 26, and the second pipe 52. In the low-pressure receiver 26, the liquid refrigerant that has not evaporated in the heat source-side heat exchanger 23 is stored as the surplus refrigerant.

(3) Control Unit 70

(3-1) Configuration of Control Unit 70

Figure 2:
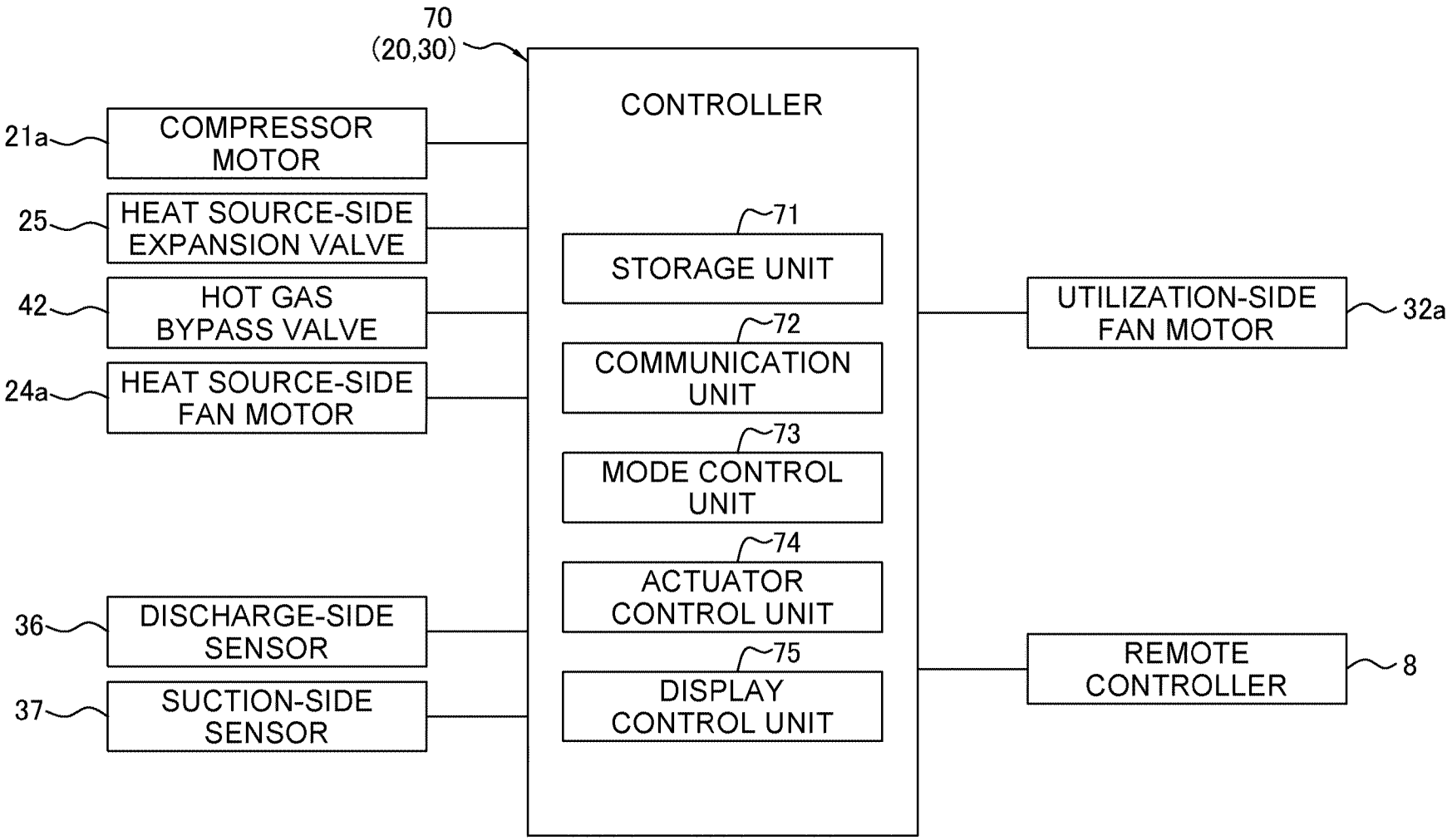
FIG. 2 is a block diagram schematically illustrating a schematic configuration of a control unit 70 and elements connected to the control unit 70.

As illustrated in FIG. 2, the control unit 70 is electrically connected to an actuator and a sensor included in the heat source unit 2. Specifically, the actuators included in the heat source unit 2 are the compressor motor 21*a* of the compressor 21, the heat source-side expansion valve 25, the hot gas bypass valve 42, and the heat source-side fan motor 24*a* of the heat source-side fan 24. Specifically, the sensors included in the heat source unit 2 are the discharge-side sensor 36 and the suction-side sensor 37. The control unit 70 is also electrically connected to the remote controller 8 and the actuators included in the utilization unit 3. Specifically, the actuator included in the utilization unit 3 is the utilization-side fan motor 32*a* of the utilization-side fan 32.

As illustrated in FIG. 2, the control unit 70 mainly includes a storage unit 71, a communication unit 72, a mode control unit 73, an actuator control unit 74, and a display control unit 75. Each element of the control unit 70 implements a specific function of the control unit 70. The control unit 70 implements these functions by executing control programs stored in the ROM, the RAM, the flash memory, and the like.

The storage unit 71 receives a request from another element of the control unit 70 and stores predetermined information in a predetermined storage area. The predetermined information is, for example, a detection value of each sensor and a command input to the remote controller 8 as a result of calculation executed by the control unit 70.

The communication unit 72 functions as a communication interface for transmitting and receiving signals to and from each device connected to the control unit 70. The communication unit 72 receives a request from the actuator control unit 74, and transmits a predetermined signal to a designated one of the actuators. The communication unit 72 receives signals output from the discharge-side sensor 36, the suction-side sensor 37, the remote controller 8, and the like, and requests the storage unit 71 to store the signals in a predetermined storage area.

The mode control unit 73 switches an operating mode of the refrigerant cycle apparatus 100.

The actuator control unit 74 controls the operation of each actuator included in the refrigerant cycle apparatus 100 on the basis of the control program. For example, the actuator control unit 74 controls the number of revolutions of the compressor 21, the opening degree of the heat source-side expansion valve 25, the opening degree of the hot gas bypass valve 42, the number of revolutions of the heat source-side fan 24, the number of revolutions of the utilization-side fan 32, and the like in real time according to the set temperature, the detection value of the sensor, and the like.

The display control unit 75 is a functional unit that controls the operation of the remote controller 8 as a display device. The display control unit 75 causes the remote controller 8 to output predetermined information in order to notify the user of information and the like related to the operation state and the situation of the refrigerant cycle apparatus 100. For example, the display control unit 75 displays information such as the operating mode and the set temperature on the display of the remote controller 8.

(3-2) Details of Control by Control Unit 70

An example of control by the control unit 70 when the refrigerant cycle apparatus 100 starts in the heating operation mode after the cooling operation mode is stopped will be described with reference to the drawings. When the refrigerant cycle apparatus 100 starts in the heating operation mode, the control unit 70 simultaneously starts a heating startup control and a bypass circuit control, and executes the heating startup control and the bypass circuit control in parallel. Before the refrigerant cycle apparatus 100 starts, the operation of the refrigerant cycle apparatus 100 is stopped. At this time, the compressor motor 21*a* is stopped, and the number of revolutions of the compressor 21 is zero. The hot gas bypass valve 42 is kept open for a certain period of time and then closed to equalize pressures on the suction side and discharge side of the compressor 21 after the cooling operation mode is stopped. Therefore, the opening degree of the hot gas bypass valve 42 at the time of the startup is zero. The opening degree of the heat source-side expansion valve 25 is a predetermined opening degree. It is assumed that the four-way switching valve 22 is in the cooling operation connection state before the refrigerant cycle apparatus 100 starts.

(3-2-1) Heating Startup Control

During execution of the heating startup control, the refrigerant cycle apparatus 100 operates in a startup operation mode (second operation) and a normal operation mode (first operation). The operation in the startup operation mode starts when the refrigerant cycle apparatus 100 starts, and is terminated when a predetermined condition is satisfied. The operation in the normal operation mode starts when the operation in the startup operation mode is terminated, and is terminated when the operation of the refrigerant cycle apparatus 100 is stopped. In the normal operation mode, various controls necessary for the refrigerant cycle apparatus 100 to execute a normal heating operation for heating the air conditioning target space are performed. In the startup operation mode, various controls that need to be executed in advance for the refrigerant cycle apparatus 100 to operate in the normal operation mode are performed. Next, referring to the flowchart in FIG. 3, the heating startup control by control unit 70 is described.

In Step S10, the control unit 70 starts the operation in the startup operation mode. Specifically, when the control unit 70 detects that the refrigerant cycle apparatus 100 starts in the heating operation mode on the basis of a command or the like input to the remote controller 8 by the user, the control unit starts the operation in the startup operation mode. As will be described later, when the operation in the startup operation mode starts, the compressor 21 starts to be rotationally driven, and the number of revolutions of the compressor 21 gradually increases from zero.

In Step S11, the control unit 70 determines whether or not a predetermined first end condition is satisfied. The first end condition is satisfied when at least one of the following four conditions A to D is satisfied.

Condition A: The discharge pressure is larger than a predetermined value.

Condition B: The suction pressure is larger than a predetermined value.

Condition C: The difference between the discharge pressure and the suction pressure is larger than a predetermined value.

Condition D: An elapsed time from the startup of the compressor 21 is longer than a predetermined time.

As the discharge pressure, for example, a value acquired by the control unit 70 based on the detection value of the discharge-side sensor 36 is used. As the suction pressure, for example, a value acquired by the control unit 70 based on the detection value of the suction-side sensor 37 is used. As the elapsed time from the startup of the compressor 21, for example, a value acquired by the control unit 70 based on a measurement value of a timer (not illustrated) included in the heat source unit 2 is used. The "predetermined value" of the conditions A to C and the "predetermined time" of the condition D are independently set.

In Step S11, in a case where the first end condition is satisfied, the process proceeds to Step S13, and in a case where the first end condition is not satisfied, the process proceeds to Step S12.

In Step S12, the control unit 70 waits until a predetermined time elapses. After the predetermined time has elapsed, the control unit 70 proceeds to Step S11. Since the compressor 21 is continuously rotationally driven while waiting in Step S12, the discharge pressure, the suction pressure, and the elapsed time from the startup of compressor 21 change. Therefore, there is a possibility that the first end condition is satisfied after the predetermined time has elapsed in Step S12. The control unit 70 repeatedly executes Steps S11 to S12 until the first end condition is satisfied.

In Step S13, the control unit 70 terminates the operation in the startup operation mode and starts the operation in the normal operation mode. Therefore, when the first end condition is satisfied, the operation in the normal operation mode is started.

(3-2-2) Bypass Circuit Control

The control unit 70 starts the bypass circuit control simultaneously with the start of the heating startup control. During execution of the bypass circuit control, the control unit 70 controls the number of revolutions of compressor 21, the opening degree of the hot gas bypass valve 42, and the opening degree of the heat source-side expansion valve 25. Next, the bypass circuit control by the control unit 70 will be described with reference to the flowchart of FIG. 4 and the time chart of FIG. 5.

Figure 5:
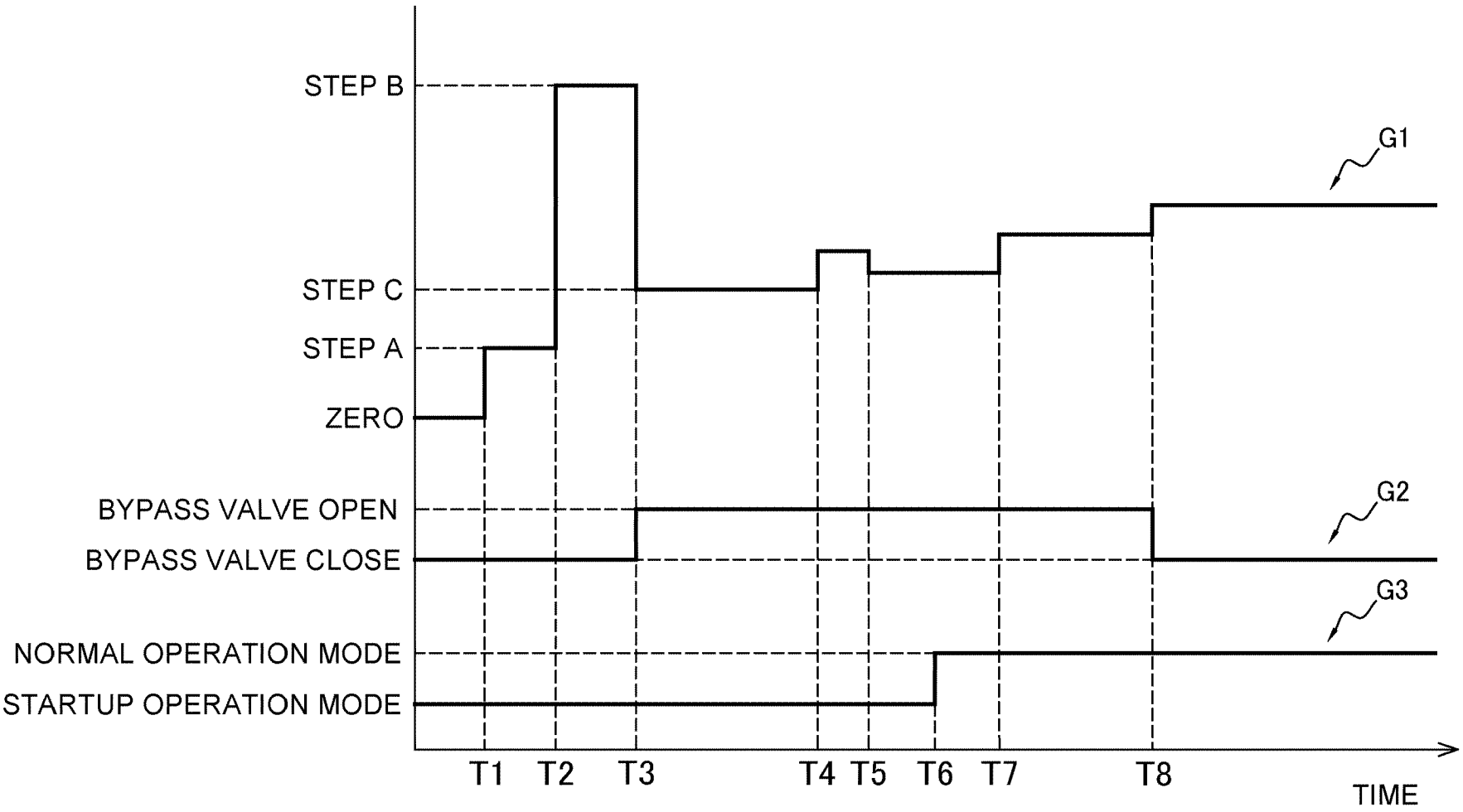
FIG. 5 is a time chart in the bypass circuit control.

FIG. 5 includes three graphs G1 to G3. The graph G1 is a time chart of the number of revolutions of the compressor 21. In the graph G1, a vertical axis represents the number of revolutions of the compressor 21. The graph G2 is a time chart of the opening degree of the hot gas bypass valve 42. In the graph G2, "bypass valve closed" represents a state in which the hot gas bypass valve 42 is closed (a state in which the opening degree is zero), and "bypass valve open" represents a state in which the hot gas bypass valve 42 is open (a state in which the opening degree is maximum). The graph G3 is a time chart illustrating a change in an operating mode (startup operation mode or normal operation mode) of the heating startup control.

In Step S20, the control unit 70 detects the start of the startup operation mode, increases the number of revolutions of the compressor 21 from zero to a predetermined first number of revolutions (Step A in FIG. 5), and starts the compressor 21 (time T1 in FIG. 5). In Step S20, the compressor 21 is driven at the first number of revolutions for a predetermined time, and then the process proceeds to Step S21.

In Step S21, the control unit 70 determines whether or not a difference between the discharge pressure and the suction pressure (hereinafter, the pressure difference is referred to as a "pressure difference") is equal to or larger than a second predetermined value. In Step S21, in a case where the pressure difference is equal to or larger than the second predetermined value, the process proceeds to Step S23, and in a case where the pressure difference is less than the second predetermined value, the process proceeds to Step S22.

In Step S22, the control unit 70 increases the number of revolutions of the compressor 21 from the first number of revolutions to a predetermined second number of revolutions (Step B in FIG. 5) (time T2 in FIG. 5). In Step S22, after the compressor 21 is driven at the second number of revolutions for a predetermined time, the process again proceeds to Step S21. The control unit 70 repeatedly executes Steps S21 to S22 until the pressure difference becomes equal to or larger than the second predetermined value. When the pressure difference becomes equal to or larger than the second predetermined value, the control unit 70 determines that the four-way switching valve 22 has been switched from the cooling operation connection state to the heating operation connection state. After Step S23, it is assumed that the four-way switching valve 22 is in the heating operation connection state.

In Step S23, the control unit 70 increases the opening degree of the hot gas bypass valve 42 from zero to a predetermined value (time T3 in FIG. 5). The control unit 70 may fully open the hot gas bypass valve 42. The control unit 70 executes the process of Step S23 in the startup operation mode. The control unit 70 executes the processing in and after Step S24 in the startup operation mode or the normal operation mode.

In Step S24, the control unit 70 decreases the number of revolutions of the compressor 21 from the second number of revolutions to a predetermined third number of revolutions (Step C in FIG. 5) (time T3 in FIG. 5). In Step S24, the compressor 21 is driven at the third number of revolutions for a predetermined time, and then the process proceeds to Step S25.

In Step S25, the control unit 70 determines whether or not a predetermined second end condition is satisfied. The second end condition is satisfied when at least one of the following three conditions E to G is satisfied.

Condition E: The degree of superheating of the refrigerant discharged from the compressor 21 is larger than a predetermined value.

Condition F: The difference between the discharge pressure and the suction pressure is larger than a predetermined value.

Condition G: The elapsed time from the startup of the compressor 21 is longer than a predetermined time.

The "predetermined value" of the conditions E to F and the "predetermined time" of the condition G are independently set.

In Step S25, when the second end condition is satisfied, the process proceeds to Step S31 (time T8 in FIG. 5). In Step S25, in a case where the second end condition is not satisfied, the process proceeds to Step S26. The control unit 70 repeatedly executes Steps S26 to S30 until the second end condition is satisfied (period from time T3 to time T8 in FIG. 5).

In Step S26, the control unit 70 increases the number of revolutions of the compressor 21 at regular time intervals (Time T4 and time T7 in FIG. 5). In a case where the processing of Step S26 is executed for the first time, the control unit 70 increases the number of revolutions of the compressor 21 when a predetermined time has elapsed since the number of revolutions of the compressor 21 reached the third number of revolutions in Step S24. The control unit 70 increases the number of revolutions of the compressor 21 when a predetermined time has elapsed from the previous time point at which the number of revolutions of the compressor 21 was increased in Step S26. When the predetermined time has not elapsed, the control unit 70 does not increase the number of revolutions of the compressor 21, Step S26 is performed to maintain the number of revolutions of the compressor 21.

In Step S27, the control unit 70 determines whether or not the pressure difference is larger than a first predetermined value. In Step S27, when the pressure difference is larger than the first predetermined value, the process proceeds to Step S28, and when the pressure difference is equal to or smaller than the first predetermined value, the process proceeds to Step S30. The first predetermined value is larger than the second predetermined value.

In Step S28, the control unit 70 decreases the number of revolutions of the compressor 21 (time T5 in FIG. 5). The control unit 70 reduces the pressure difference by reducing the number of revolutions of the compressor 21. In Step S28, after the control unit 70 decreases the number of revolutions of the compressor 21, the process proceeds to Step S29.

In Step S29, the control unit 70 waits until a predetermined time elapses. In Step S29, after the predetermined time has elapsed, the process proceeds to Step S25.

In Step S30, the control unit 70 waits until a predetermined time elapses. In Step S30, after the predetermined time has elapsed, the process proceeds to Step S25.

In Step S31, the control unit 70 sets the opening degree of the hot gas bypass valve 42 to zero and closes the hot gas bypass valve 42. Therefore, when the second end condition is satisfied, the hot gas bypass valve 42 is closed.

(3-2-3) Other Control

After opening the hot gas bypass valve 42 in Step S23, the control unit 70 starts a flow rate adjustment control for adjusting the opening degree of the heat source-side expansion valve 25 so that the amount of the refrigerant circulating through the main refrigerant circuit 10 falls within an appropriate range. The flow rate adjustment control is performed, for example, by adjusting the opening degree of the heat source-side expansion valve 25 based on the refrigerant temperature (evaporation temperature) on the outlet side of the heat source-side heat exchanger 23. The control unit 70 continues the flow rate adjustment control even after closing the hot gas bypass valve 42 in Step S31.

In a case where the normal operation mode is set when the hot gas bypass valve 42 is closed in Step S31, the control unit 70 starts a compressor normal control for controlling the number of revolutions of the compressor 21 based on the difference between the set temperature and the current temperature of the air conditioning target space. The set temperature is, for example, a temperature of the air conditioning target space input to the remote controller 8 by the user. As a result, the control unit 70 can adjust the number of revolutions of the compressor 21 to an appropriate value according to the load of the air conditioning target space.

Figure 6:
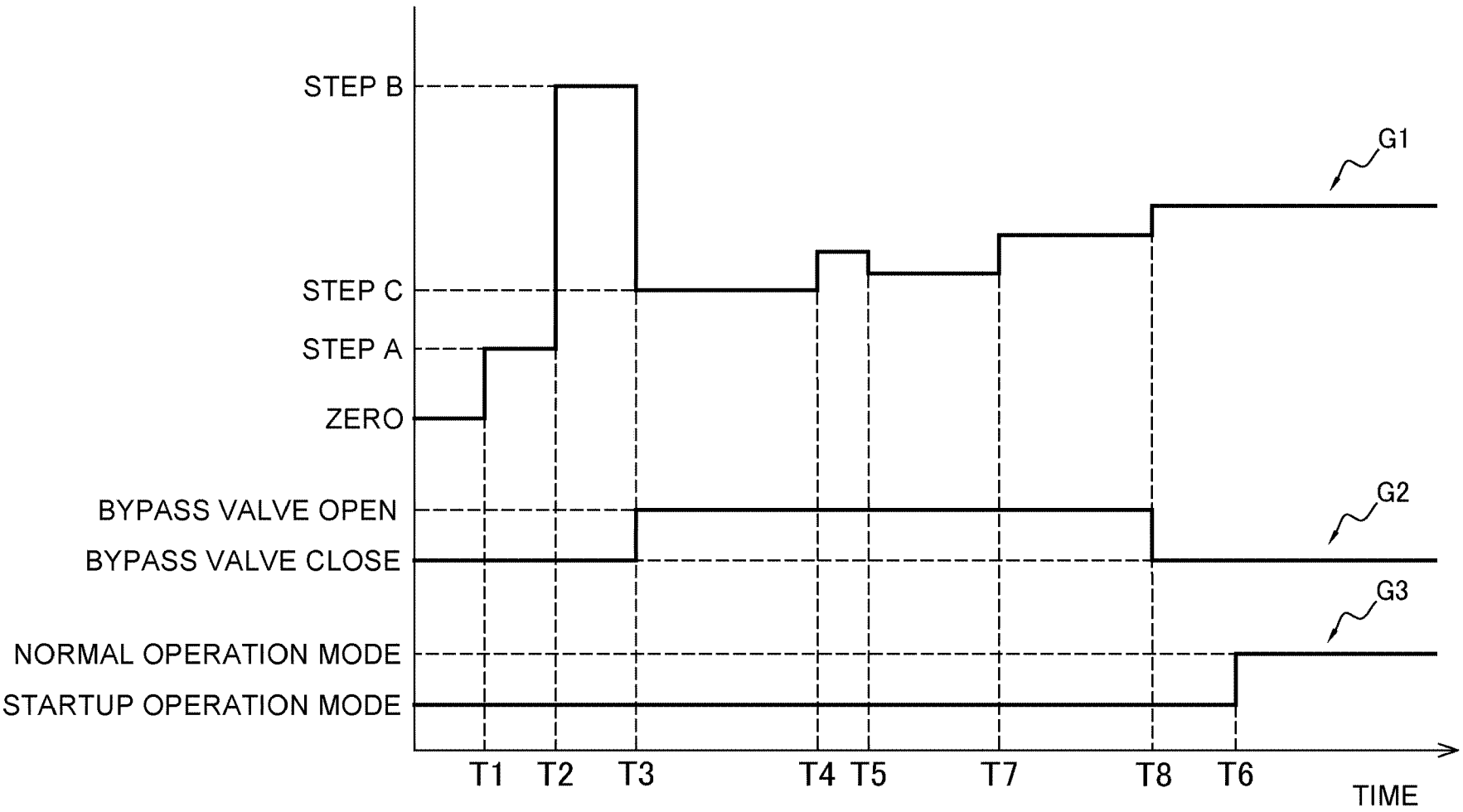
FIG. 6 is a time chart in the bypass circuit control.

The control unit 70 executes the heating startup control and the bypass circuit control in parallel. Therefore, a first end time point (time T6 in FIG. 5) at which the first end condition is satisfied in the heating startup control may be before or after the second end time point (time T8 in FIG. 5) at which the second end condition is satisfied in the bypass circuit control. Which of the first end condition and the second end condition is satisfied first depends on the state of the refrigerant based on the outside air temperature or the like. FIG. 5 is a time chart in a case where the first end time point is before the second end time point. FIG. 6 is a time chart in a case where the first end time point is later than the second end time point.

(4) Features (4-1)

The refrigerant cycle apparatus 100 according to the present embodiment can suppress sound of the refrigerant passing through the bypass circuit 40 by controlling the number of rotations of the compressor 21 to suppress the pressure difference between the discharge side and the suction side of the compressor 21.

In the air conditioner (refrigerant cycle apparatus 100) of a type in which a plurality of indoor units (utilization units 3) are connected to one outdoor unit (heat source unit 2), the compressor (compressor 21) of the outdoor unit has a relatively large capacity. Therefore, the sound generated from the compressor, the outdoor fan (heat source-side fan 24), and the like during operation is large, and the sound of the refrigerant passing through the valve (hot gas bypass valve 42) is inconspicuous. However, when the capacity of the compressor of the outdoor unit is relatively small, the sound generated from the compressor, the outdoor fan, and the like during operation is small, and thus, there is a risk that the sound of the refrigerant passing through the valve may be conspicuous.

Also in the refrigerant cycle apparatus 100 according to the present embodiment, when the difference (pressure difference) between the pressure on the discharge side and the pressure on the suction side of the compressor 21 becomes too large, the amount of the refrigerant flowing through the bypass circuit 40 may increase, leading to an increase in sound of the refrigerant passing through the hot gas bypass valve 42. However, in the refrigerant cycle apparatus 100, the control unit 70 performs control to reduce the number of revolutions of the compressor 21 as necessary so that the pressure difference becomes equal to or less than the first predetermined value at the time of the startup of the heating operation and at the time of the normal operation (Step S28 in FIG. 4). Therefore, in the refrigerant cycle apparatus 100, since an increase in the amount of the refrigerant flowing through the bypass circuit 40 is suppressed, an increase in the sound of the refrigerant passing through the hot gas bypass valve 42 is suppressed.

(4-2)

In the refrigerant cycle apparatus 100 according to the present embodiment, the control unit 70 closes the hot gas bypass valve 42 at the time of the startup of the heating operation until it is determined that the four-way switching valve 22 has been switched from the cooling operation connection state to the heating operation connection state. Specifically, when the pressure difference is larger than the second predetermined value, the control unit 70 determines that the four-way switching valve 22 has been switched to the heating operation connection state, and opens the hot gas bypass valve 42 (Step S21 in FIG. 4). Therefore, in the refrigerant cycle apparatus 100, the refrigerant is prevented from flowing to the bypass circuit 40 at the time of the startup of the heating operation, and thus, the pressure difference between the discharge side and the suction side of the compressor 21 is appropriately secured.

(4-3)

In the refrigerant cycle apparatus 100 according to the present embodiment, after the pressure difference becomes larger than the second predetermined value and the hot gas bypass valve 42 is opened, the control unit 70 performs control to reduce the number of rotations of the compressor 21 as necessary so that the pressure difference becomes equal to or less than the first predetermined value. Therefore, in the refrigerant cycle apparatus 100, the pressure difference between the discharge side and the suction side of the compressor 21 is maintained within an appropriate range at the time of the startup of the heating operation and at the time of the normal operation.

(4-4)

Figure 3:
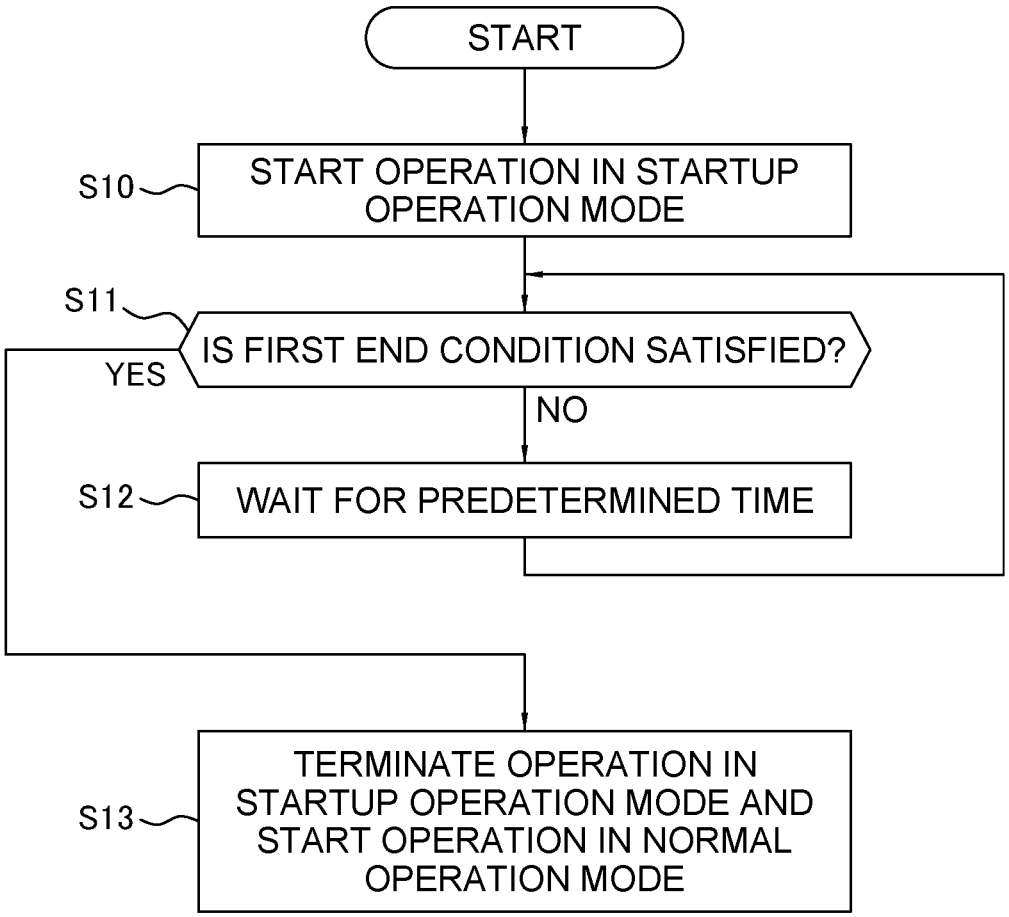
FIG. 3 is a flowchart illustrating an example of a flow of processing of a heating startup control.

In the refrigerant cycle apparatus 100 according to the present embodiment, when the first end condition is satisfied, the control unit 70 terminates the startup operation mode and starts the normal operation mode (Step S11 in FIG. 3). The first end condition is satisfied when the elapsed time from the startup of the compressor 21 becomes longer than a predetermined time. Therefore, in the refrigerant cycle apparatus 100, the occurrence of problems that prevents the transition from the startup operation mode to the normal operation mode is suppressed.

(4-5)

Figure 4:
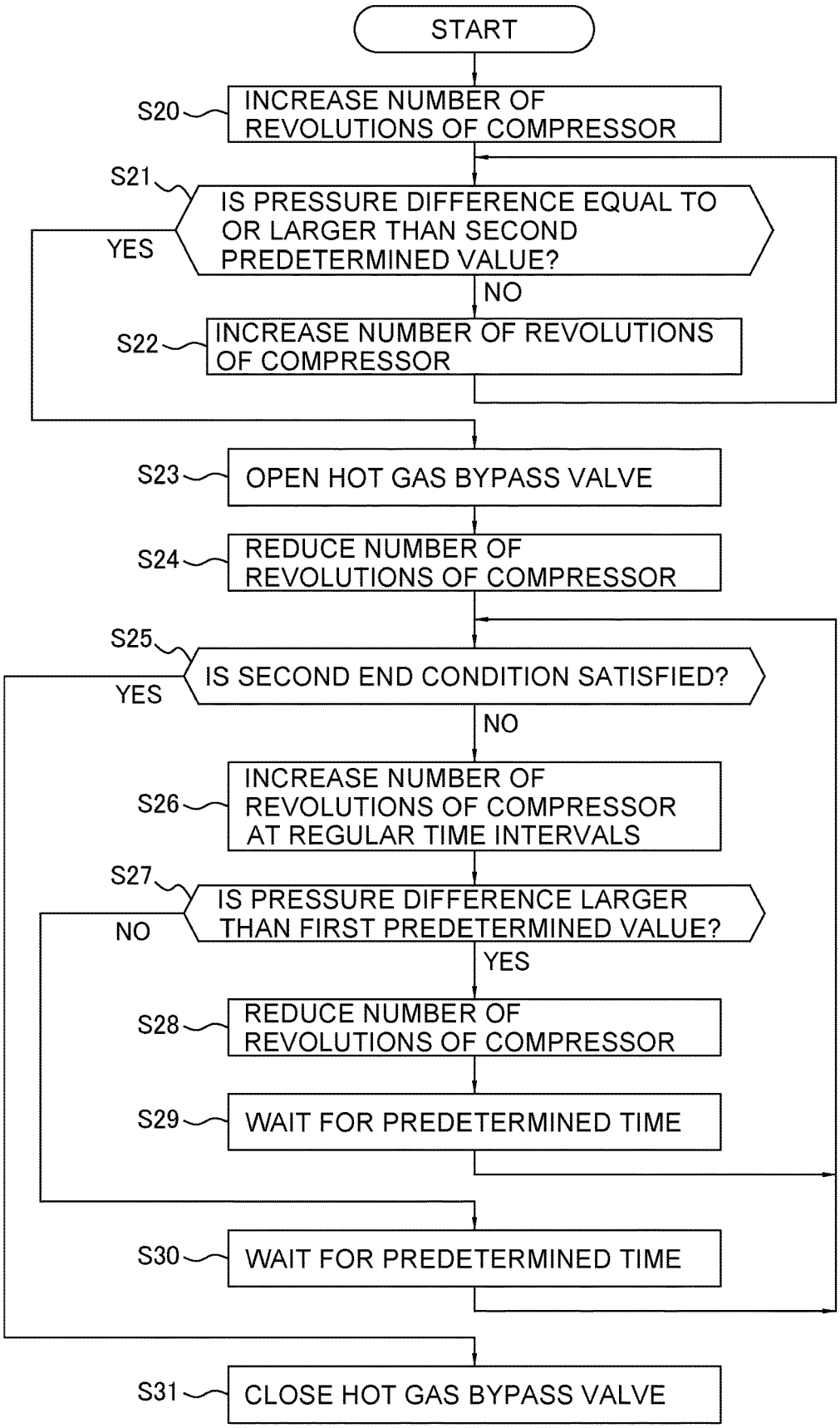
FIG. 4 is a flowchart illustrating an example of a flow of processing of a bypass circuit control.

In the refrigerant cycle apparatus 100 according to the present embodiment, when the second end condition is satisfied, the control unit 70 closes the hot gas bypass valve 42 and starts the normal operation for adjusting the number of revolutions of the compressor 21 according to the load of the air conditioning target space (Step S25 in FIG. 4). The second end condition is satisfied when the elapsed time from the startup of the compressor 21 becomes longer than a predetermined time. Therefore, in the refrigerant cycle apparatus 100, the occurrence of problems in which the normal operation is continued with the hot gas bypass valve 42 kept open is suppressed.

(5) Modifications (5-1) Modification A

When the second end condition is satisfied and the hot gas bypass valve 42 is closed, the control unit 70 may further perform control to increase the opening degree of the heat source-side expansion valve 25. When the hot gas bypass valve 42 is closed, the amount of refrigerant flowing through the main refrigerant circuit 10 temporarily increases, in order to maintain the amount of refrigerant flowing through the main refrigerant circuit 10 at an appropriate amount, for example, it is necessary to temporarily reduce the number of revolutions of the compressor 21 so as to reduce the amount of refrigerant discharged from the compressor 21. However, during the normal operation, the number of revolutions of the compressor 21 is preferably maintained at an appropriate value based on the load of the air conditioning target space and the like. In the present modification, the control unit 70 maintains the amount of the refrigerant flowing through the main refrigerant circuit 10 at an appropriate amount by increasing the opening degree of the heat source-side expansion valve 25 instead of temporarily reducing the number of revolutions of the compressor 21.

In the present modification, when the hot gas bypass valve 42 is closed, preferably, the control unit 70 predicts an appropriate opening degree of the heat source-side expansion valve 25 based on the amount of the refrigerant flowing through the main refrigerant circuit 10, and performs control to adjust the opening degree of the heat source-side expansion valve 25. For example, the control unit 70 performs control to adjust the opening degree of the heat source-side expansion valve 25 such that the amount of refrigerant flowing through the main refrigerant circuit 10 reaches a predetermined target value. In addition, the control unit 70 may perform control to adjust the opening degree of the heat source-side expansion valve 25 based on the ratio between the amount of the refrigerant flowing through the main refrigerant circuit 10 and the amount of the refrigerant flowing through the bypass circuit 40. In this case, the control unit 70 calculates the amount of refrigerant flowing through the main refrigerant circuit 10 based on the suction pressure acquired from the suction-side sensor 37 and the number of revolutions of the compressor 21. The control unit 70 calculates the amount of the refrigerant flowing through the bypass circuit 40 based on the discharge pressure acquired from the discharge-side sensor 36 and the pressure difference between the discharge pressure and the suction pressure.

In the present modification, the control unit 70 may increase the opening degree of the heat source-side expansion valve 25 when the hot gas bypass valve 42 is closed during the normal operation in which the flow rate adjustment control is performed. The flow rate adjustment control is control for adjusting the opening degree of the heat source-side expansion valve 25 based on the refrigerant temperature (evaporation temperature) on the outlet side of the heat source-side heat exchanger 23 so that the amount of the refrigerant circulating in the main refrigerant circuit 10 falls within an appropriate range. For example, the control unit 70 performs control to adjust the opening degree of the heat source-side expansion valve 25 so that conditions such as the degree of subcooling of the utilization-side heat exchanger 31 and the degree of superheating of the heat source-side heat exchanger 23 becoming predetermined target values are satisfied. In this case, as illustrated in FIG. 7, the control unit 70 may adjust the opening degree of the heat source-side expansion valve 25 by a feedforward control triggered by closing of the hot gas bypass valve 42.

Figure 7:
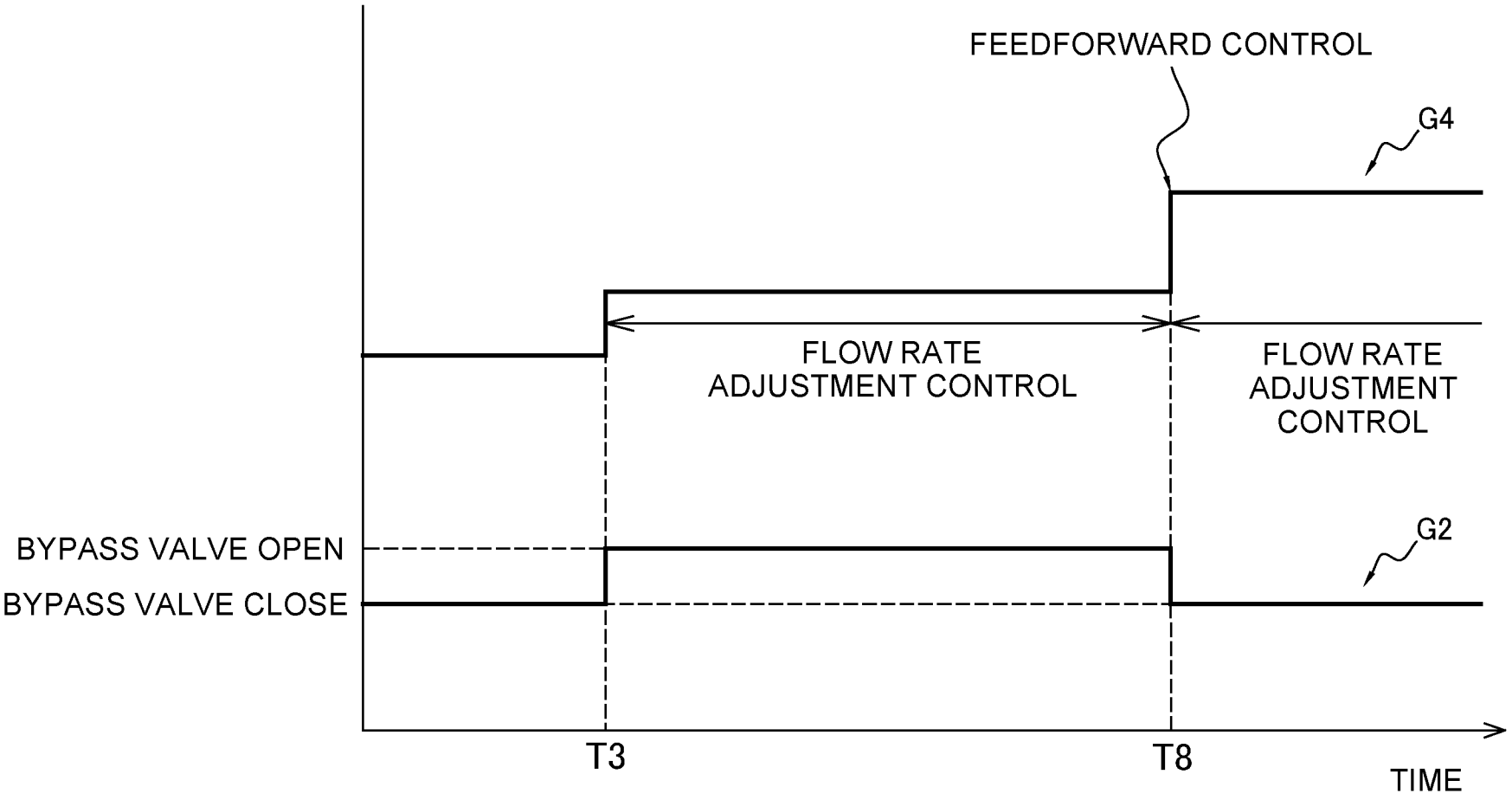
FIG. 7 is a time chart illustrating a change in an opening degree of a heat source-side expansion valve 25 by a feedforward control triggered by closing of the hot gas bypass valve 42.

FIG. 7 includes two graphs G2 and G4. The graph G2 is the same as the graph G2 in FIGS. 5 and 6. Graph G4 is a time chart of the opening degree of the heat source-side expansion valve 25. In the graph G4, a vertical axis represents an image of the opening degree of the heat source-side expansion valve 25. Similarly to FIGS. 5 and 6, the time T3 represents a time when the hot gas bypass valve 42 is opened, and the time T8 represents a time when the hot gas bypass valve 42 is closed.

As illustrated in FIG. 7, the opening degree of the heat source-side expansion valve 25 maintains a predetermined opening degree during a period from the startup of the refrigerant cycle apparatus 100 to the time T3 at which the hot gas bypass valve 42 opens. After the hot gas bypass valve 42 is opened at the time T3, the control unit 70 starts the flow rate adjustment control. While performing the flow rate adjustment control, the control unit 70 adjusts the opening degree of the heat source-side expansion valve 25 in real time based on the refrigerant temperature (evaporation temperature) and the like on the outlet side of the heat source-side heat exchanger 23. When detecting that the hot gas bypass valve 42 is closed at the time T8, the control unit 70 performs the feedforward control to increase the opening degree of the heat source-side expansion valve 25 by a predetermined amount while continuing the flow rate adjustment control. An amount of increase in the opening degree of the heat source-side expansion valve 25 may be determined in accordance with the state of the refrigerant at the time T8 or the like. As a result, even when the bypass circuit 40 is closed during the normal operation, the amount of refrigerant flowing through the main refrigerant circuit 10 is maintained at an appropriate amount without temporarily reducing the number of revolutions of the compressor 21.

In the present modification, the refrigerant cycle apparatus 100 can continue the normal heating operation (flow rate adjustment control) without temporarily reducing the number of revolutions of the compressor 21 after the bypass circuit 40 is closed.

(5-2) Modification B

When the four-way switching valve 22 is in the heating operation connection state at the time of the previous stop of the compressor 21, the control unit 70 may open the hot gas bypass valve 42 at the same time as the startup of the compressor 21 in the startup operation mode. In this case, since the four-way switching valve 22 is already in the heating operation connection state at the time of the startup of the compressor 21, the control unit 70 can omit the processing of Steps S21 to S22 in FIG. 4. As a result, the control unit 70 can shorten the time required for the bypass circuit control.

(5-3) Modification C

When the refrigerant cycle apparatus 100 is exclusively used for the heating operation, the heat source unit 2 may not include the four-way switching valve 22. In this case, the control unit 70 does not execute the processing of Steps S21 to S22 of FIG. 4 in the bypass circuit control. Therefore, after the compressor 21 is driven at the first number of revolutions for a predetermined time in Step S20, the control unit 70 can increase the number of revolutions of the compressor 21 from the first number of revolutions to the third number of revolutions in Step S23.

<Conclusion>

Although the embodiments of the present disclosure have been described above, it will be understood that various changes in form and details can be made without departing from the spirit and scope of the present disclosure described in claims.

REFERENCE SIGNS LIST

10: main refrigerant circuit
21: compressor
22: four-way switching valve
23: heat source-side heat exchanger (first heat exchanger)
25: heat source-side expansion valve (expansion mechanism)
31: utilization-side heat exchanger (second heat exchange unit)
36: discharge-side sensor (first sensor)
37: suction-side sensor (second sensor)
40: bypass circuit
42: hot gas bypass valve (first valve)
70: control unit
100: refrigerant cycle apparatus

CITATION LIST

Patent Literature

Patent Literature 1: JP 2010-249464 A

The invention claimed is:

1. A refrigerant cycle apparatus comprising:

a main refrigerant circuit which includes a compressor, a four-way switching valve, a first heat exchanger, an expansion mechanism, and a second heat exchanger and through which a refrigerant circulates;

a bypass circuit having a first valve that opens and closes, the bypass circuit connecting a first point and a second point, the first point is between a discharge port of the compressor and the four-way switching valve, the second point is between a suction port of the compressor and the four-way switching valve;

a first sensor configured to acquire a first pressure that is a pressure of the refrigerant on a discharge side of the compressor;

a second sensor configured to acquire a second pressure that is a pressure of the refrigerant on a suction side of the compressor; and a controller, wherein the controller performs a second operation of opening the first valve in a state in which the compressor is driven, before performing a first operation in which the first heat exchanger serves as a heat absorber of the refrigerant and the second heat exchanger serves as a radiator of the refrigerant, and the controller reduces the number of revolutions of the compressor when a pressure difference, which is a difference between the first pressure and the second pressure, becomes larger than a first predetermined value in the first operation or the second operation.

2. The refrigerant cycle apparatus according to claim 1, wherein the four-way switching valve has a first state in which the discharge side of the compressor communicates with the second heat exchanger and the suction side of the compressor communicates with the first heat exchanger, and a second state in which the discharge side of the compressor communicates with the first heat exchanger and the suction side of the compressor communicates with the second heat exchanger, and when the pressure difference becomes equal to or larger than a second predetermined value in the second operation, the controller determines that the four-way switching valve has been switched from the second state to the first state, and the controller opens the first valve after determining that the four-way switching valve has been switched from the second state to the first state.

3. The refrigerant cycle apparatus according to claim 2, wherein the first predetermined value is larger than the second predetermined value.

4. The refrigerant cycle apparatus according to claim 2, wherein the controller reduces the number of revolutions of the compressor when the pressure difference becomes larger than the first predetermined value after the first valve is opened.

5. The refrigerant cycle apparatus according to claim 2, wherein the four-way switching valve has the first state in which the discharge side of the compressor communicates with the second heat exchanger and the suction side of the compressor communicates with the first heat exchanger, and the second state in which the discharge side of the compressor communicates with the first heat exchanger and the suction side of the compressor communicates with the second heat exchanger, and when the four-way switching valve is in the first state at a previous stop of the compressor, the controller opens the first valve at the same time as startup of the compressor in the second operation.

6. The refrigerant cycle apparatus according to claim 1, wherein the controller terminates the second operation and starts the first operation when a first operation condition is satisfied, and the first operation condition includes any one of the first pressure being larger than a second predetermined value;

the second pressure being larger than a third predetermined value;

the pressure difference being larger than a fourth predetermined value; and an elapsed time from startup of the compressor being longer than a predetermined time.

7. The refrigerant cycle apparatus according to claim 1, wherein the controller increases an opening degree of the expansion mechanism when the first valve is closed.

8. The refrigerant cycle apparatus according to claim 7, wherein the controller controls the opening degree of the expansion mechanism based on an amount of the refrigerant flowing through the main refrigerant circuit, when the first valve is closed.

9. The refrigerant cycle apparatus according to claim 7, wherein the controller controls the opening degree of the expansion mechanism based on a refrigerant temperature on an outlet side of the first heat exchanger, in the first operation, and the controller increases the opening degree of the expansion mechanism when the first valve is closed, in the first operation or the second operation.

10. A refrigerant cycle apparatus comprising:

a main refrigerant circuit which includes a compressor, a four-way switching valve, a first heat exchanger, an expansion mechanism, and a second heat exchanger and through which a refrigerant circulates;

a bypass circuit having a first valve that opens and closes, the bypass circuit branching off from a pipe on a discharge side of the compressor and being connected to a pipe on a suction side of the compressor;

a first sensor configured to acquire a first pressure that is a pressure of the refrigerant on the discharge side of the compressor;

a second sensor configured to acquire a second pressure that is a pressure of the refrigerant on the suction side of the compressor; and a controller, wherein the controller performs a second operation of opening the first valve in a state in which the compressor is driven, before performing a first operation in which the first heat exchanger serves as a heat absorber of the refrigerant and the second heat exchanger serves as a radiator of the refrigerant, the controller reduces the number of revolutions of the compressor when a pressure difference, which is a difference between the first pressure and the second pressure, becomes larger than a first predetermined value in the first operation or the second operation, the controller closes the first valve when a closing condition is satisfied, and the closing condition includes any one of a degree of superheating of the refrigerant discharged from the compressor being larger than a second predetermined value;

the pressure difference being larger than a third predetermined value; and an elapsed time from startup of the compressor being longer than a predetermined time.

* * * * *